United States Patent [19]

Briggs

[11] 4,165,027

[45] Aug. 21, 1979

[54] SKI AND SKI POLE ASSEMBLY

[76] Inventor: Robert W. Briggs, 10421 Prado Woods, Villa Park, Calif. 92667

[21] Appl. No.: 879,125

[22] Filed: Feb. 21, 1978

[51] Int. Cl.[2] ..... B65D 71/00

[52] U.S. Cl. ..... 224/45 S; 280/11.37 K; 24/73 SG

[58] Field of Search ..... 224/45 S, 55, 58, 5 E, 224/5 Z; 280/11.37 K, 11.37 A, 11.37 B, 11.37 E; 24/81 SK, 73 SG, 81 CC, 16 R, 16 PB, 17 AP, 73 PB; 248/68 CB, 68 R, 74 A, 74 B

[56] References Cited

U.S. PATENT DOCUMENTS

| | | | |
|---|---|---|---|
| 3,169,290 | 2/1965 | Snodgrass | 224/45 S |
| 3,486,672 | 12/1969 | Esopi | 224/45 S |
| 3,905,610 | 9/1975 | Dini | 224/45 S |

FOREIGN PATENT DOCUMENTS

| | | | |
|---|---|---|---|
| 1906477 | 2/1969 | Fed. Rep. of Germany | 280/11.37 K |
| 102282 | 3/1966 | United Kingdom | 24/73 PB |

*Primary Examiner*—Robert J. Spar
*Assistant Examiner*—Kenneth W. Noland
*Attorney, Agent, or Firm*—Fulwider, Patton, Rieber, Lee & Utecht

[57] ABSTRACT

A retainer for skis and ski poles which, when used in two or more, forms a unitary assembly of a pair of skis and ski poles. Each retainer comprises a web band for encircling a pair of skis in bottom-to-bottom parallel alignment and, attached thereto, a clamp block having a pair of parallel, coextensive through bores for receiving the ski poles and a lock to secure said clamp block in gripping engagement of the received ski poles. Preferably the entire retainer is molded of a resilient elastomer, e.g., rubber and the like. The assembly of the skis and ski poles employs a pair of the retainers, at opposite ends of the assembly securing the skis in parallel, bottom-to-bottom array, and a parallel array of the ski poles.

8 Claims, 4 Drawing Figures

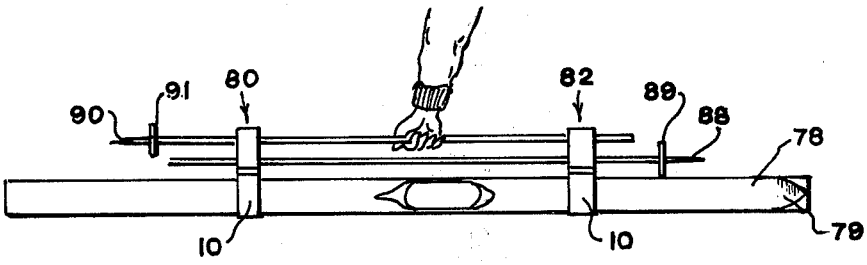
FIGURE 4
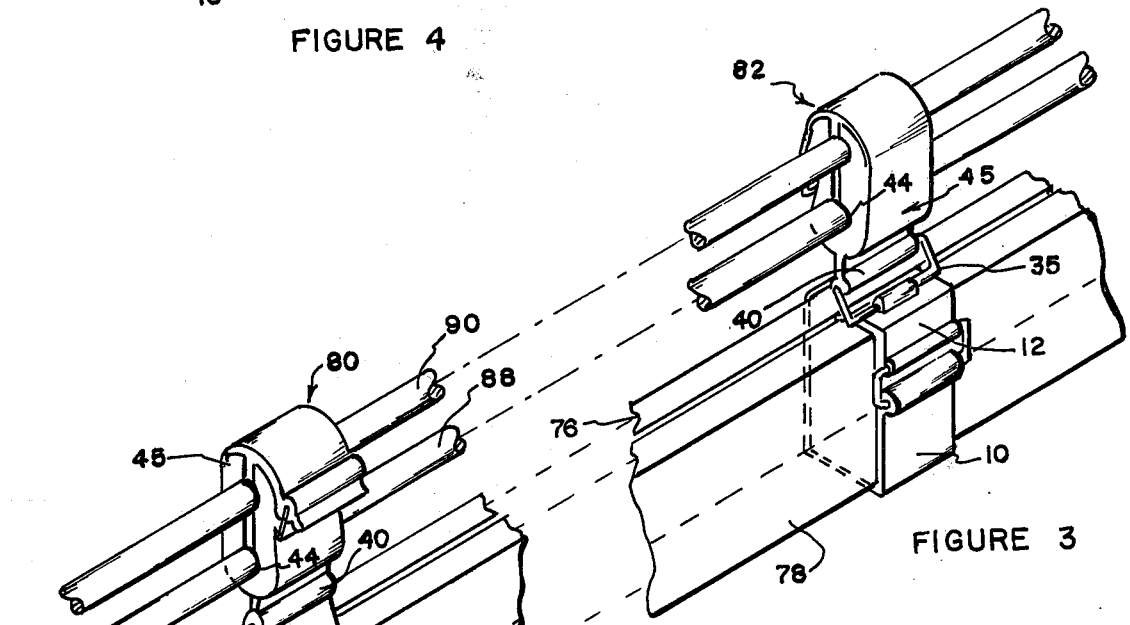
FIGURE 3
FIGURE 2
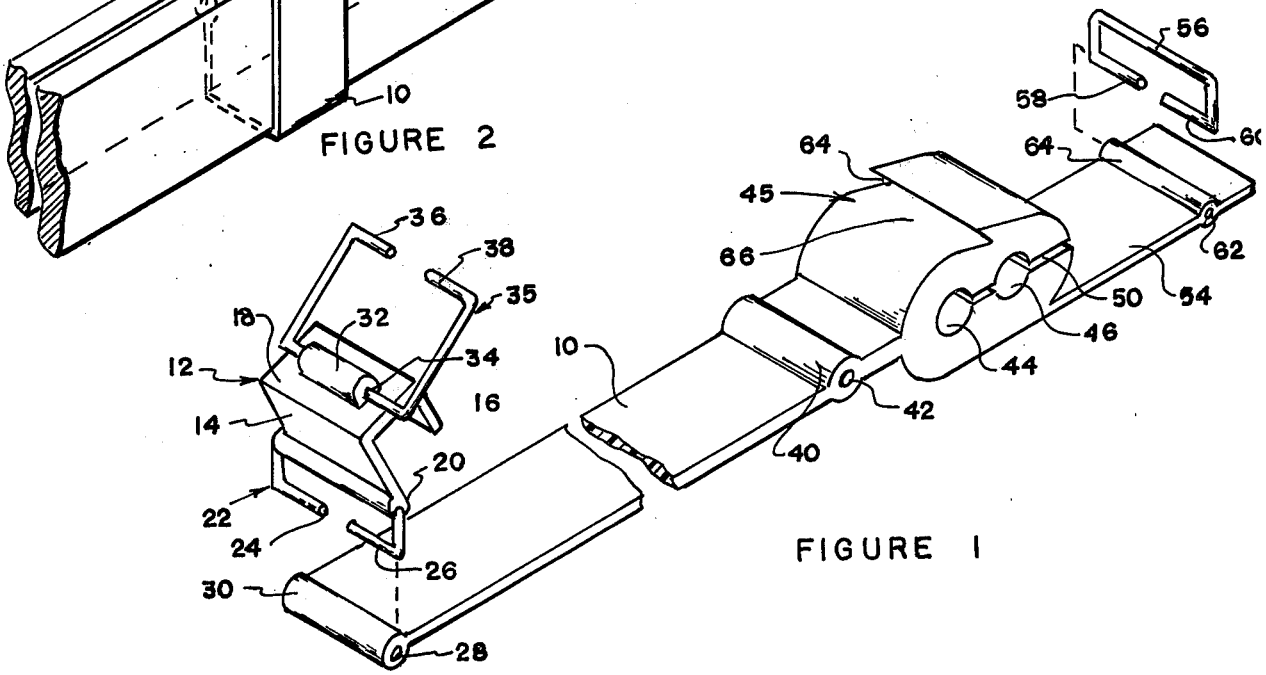
FIGURE 1

SKI AND SKI POLE ASSEMBLY

BACKGROUND OF THE INVENTION

This invention relates to ski retainers and in particular two retainers for assembling a pair of skis and ski poles in a unitary package.

BRIEF STATEMENT OF THE PRIOR ART

Skis and ski poles are extremely awkward and cumbersome for transportation and storage. A device recently introduced to the market comprises a web band of rubber and the like which has a bracket at one end to engage the edge of a ski and which is encircled about a pair of skis to retain the skis in a bottom-to-bottom array.

The aforedescribed retainer, however, has no means for assembling the ski poles together or in a single package with the skis. Some users hook the throng grip of the ski pole about one end of the skis, however, this often only encumbers an otherwise acceptable assembly.

BRIEF STATEMENT OF THE INVENTION

This invention comprises a retainer for assembly and carrying a pair of skis and ski poles. The retainer comprises band web means for encircling a pair of skis in a bottom-to-bottom parallel array with clamp block means carried by the band web means and having a pair of parallel, coextensive through bores for receiving a pair of ski poles in parallel alignment and supporting the poles in the assembly in parallel alignment to the skis. The band web and block clamp means are preferably of molded, one-piece construction and can be formed of a suitable resilient material such as an elastomer. The lock means for gripping the ski poles preferably comprises a slit in the block clamp means which intersects the through bores, permitting the block clamp means to be spread open at the through bores for receiving the poles. A band web is provided for securing about the block clamp means, to compress the clamp and through bores about the received ski poles.

BRIEF DESCRIPTION OF THE DRAWINGS

The invention will be described with reference to the figures of which:

FIG. 1 illustrates a retainer of the invention;

FIGS. 2 and 3 are perspective views of an assembly of skis, ski poles and the retainer of the invention; and FIG. 4 illustrates the manner of carrying the assembly.

DESCRIPTION OF PREFERRED EMBODIMENT

Referring to FIG. 1, the retainer of the invention comprises a band web 10 for encircling a pair of skis. Band web 10 bears, at one end, bracket means for engaging to the edge of a ski. The bracket means comprises a rigid bracket member 12 of general channel configuration, having side walls 14 and 16 and a bottom web 18. One side wall, 14, is formed with a through bore 20 along its free edge to receive a bent link 22. Link 22 has reverse bends 24 and 26 which are received in opposite ends of through bore 28 carried in a bulbous edge 30 of the band web 10. The web of the channel bracket 12 also bears a longitudinal rib 32 which has a through bore 34 to receive link member 35. Link member 35 has opposite return bends 36 and 38.

The opposite end of band web 10 has a second bulbous portion 40 which has a coextensive through bore 42. Bore 42 receives, as described hereinafter, the reverse bends 36 and 38 of the link member 35.

Attached to the band web 10 is a clamp block means 45 which has a pair of parallel, coextensive through bores 44 and 46. Preferably clamp block means 45 has a slit 50 which intersects the through bores 44 and 46 and is coextensive therewith, whereby the block clamp 45 may be spread apart to expand the through bores for receiving ski poles.

The clamp block means 45 includes lock means for locking the clamp block means in a gripping relationship to ski poles received in through bores 44 and 46. The lock means of the preferred embodiment comprises a second band web 54 which extends from the free end of the clamp block means 45 and which bears, at its outboard end, a link 56 having reverse bend ends 58 and 60 received in a bore 62 of a bulbous portion 64 near the end 66 of the band web. The link 56 is adapted to engage retainer means on the opposite side of the clamp block means 45. The retainer means of the preferred embodiment comprises a groove 64 coextensive with the side of the block clamp 42 opposite web 54. Preferably the groove 64 is molded into the clamp block face 66 and inclined thereto whereby the undercut portion forms groove 64 to serve as a hook-like retainer for link 56.

Referring now to FIGS. 2 and 3, the retainer of the invention is shown in assembly with a pair of skis and ski poles. The skis 76 and 78 are placed in bottom-to-bottom array with the shovel or tips (not shown) projecting outwardly. The retainers are encircled about the pair of skis and to this end, the edge gripping brackets 12 can be placed about the edge of one ski to secure the end of the band webs 10 which are then stretched about the skis and secured by placing the reverse bend ends 36 and 38 of the link member 35 in the through bores 42 in bulbous portions 40 of the bank webs 10. A first retainer 80 and a second retainer 82 of the invention are placed at opposite ends of the pair of skis in this fashion, as shown in FIGS. 2 and 3.

The ski poles can then be secured in the assembly by placing the first ski pole in the innermost aligned set of through bores 44 of the clamp block means 45 of each of the retainers 80 and 82. This assembly is facilitated by spreading the slit half portions of the clamp block means 45 apart to permit seating of the ski pole in the through bores 44. After the first ski pole 88 is placed in the assembly in this manner, the second ski pole 90 is oriented, preferably with its basket end 91 reversed from the basket end 89 of ski pole 88, and inserted into the outermost aligned pair of through bores 46. This alignment is shown in FIG. 4. Thereafter, the band webs 54 are stretched taut over their respective clamp block means 45 and the hoops 56 are seated in the retainer grooves 64, completing the assembly. Also as shown in FIG. 4, the tips 79 of the skis can be reversed, end-to-end, if desired.

The assembly of skis and ski poles affords a number of significant advantages. Firstly, the skis and ski poles are in a single, unitary package and are protected from loss or separation. As shown in FIG. 4, the complete package is very portable and can be easily carried by one hand, gripping either the ski poles or the skis. The package can be quickly and easily disassembled and the retainers are very compact and can be folded and easily inserted in the pockets of wearing apparel and the like. Finally, the retainers are of very simple, integral construction which lends itself very readily to molding of elastomers and similar plastics, thereby providing very efficient and inexpensive mass production.

The invention has been described with reference to the illustrated and preferred embodiment. It is not intended that this reference to the presently preferred embodiments be unduly restrictive of the invention. Instead, the invention is intended to be defined by the means, and their obvious equivalents, set forth in the following claims.

I claim:

1. A retainer for an assembly of a pair of skis and ski poles which comprises:

(a) a continuous first web band for encircling a pair of skis in bottom-to-bottom array;

(b) securing means to secure said first web band in encirclement about said pair of skis;

(c) an integrally formed clamp block carried at one end of said first web band and comprising a block having a pair of parallel, coextensive through bores bearing an end slit opposite said first web band, parallel to and intersecting said through bores to receive said ski poles and thereby permit said ski poles to be secured at one end of said first web band;

(d) lock means comprising a second, integrally formed web band secured at one end to said clamp block to overlie said slit and a web band retainer means to secure said second web band in overlay of said slit, to secure said ski poles in said clamp block in parallel alignment to said pair of skis.

2. The retainer of claim 1 wherein said securing means comprises link means distally carried by said first web band having hook ends to secure the opposite end of said first web band.

3. The retainer of claim 2 including channel bracket means distally carried by said first web band to receive an edge of a ski and bearing said link means.

4. The retainer of claim 1 wherein said web band retainer means comprises a second link member distally carried by said second web band and a cooperative groove means in the side of said clamp block to receive said second link member.

5. The retainer of claim 4 wherein said first and second web bands and clamp block are a one-piece molded lastomer.

6. The retainer of claim 4 wherein said first and second web bands, clamp block and cooperative groove means are a one-piece molded elastomer.

7. The retainer of claim 1 comprising a unitary package of a single pair each of skis and ski poles with said skis in parallel bottom-to-bottom array and encircled, at opposite ends, by the first web band, with said ski poles also in parallel array and each received in respective aligned through bores of said clamp block.

8. The package of claim 7 wherein said ski poles are in reversed end alignment with the baskets of the poles at opposite ends of said array.

* * * * *